US005425385A

United States Patent [19]

Kuta et al.

[11] Patent Number: 5,425,385

[45] Date of Patent: Jun. 20, 1995

[54] ROTARY WASHER SPRAYING SYSTEM

[75] Inventors: Ken Kuta, Rockford, Ill.; Antonio Fernandez, Danbury, Conn.

[73] Assignee: PepsiCo. Inc., Purchse, N.Y.

[21] Appl. No.: 90,595

[22] Filed: Jul. 12, 1993

[51] Int. Cl.[6] ..... B08B 3/02; B08B 9/08

[52] U.S. Cl. ..... 134/48; 134/50; 134/52; 134/57 R; 134/58 R; 134/62; 134/66; 134/80; 134/95.2; 134/95.3; 134/103.3; 134/104.1; 134/113; 134/142; 134/152; 134/153; 134/159; 141/83; 239/71

[58] Field of Search ..... 134/48, 50, 52, 53, 134/54, 57 R, 58 R, 62, 66, 80, 95.2, 95.3, 103.3, 104.1, 113, 142, 144, 145, 152, 153, 159; 239/71; 141/83

[56] References Cited

U.S. PATENT DOCUMENTS

| | | | |
|---|---|---|---|
| 2,967,531 | 1/1961 | Nussbaum | 134/95.3 |
| 3,240,216 | 3/1966 | Sadwith | 134/142 X |
| 3,311,500 | 3/1967 | Seto | 134/66 X |
| 3,587,597 | 6/1971 | Courtney et al. | 134/95.2 |
| 3,614,958 | 10/1971 | Perrier | 134/48 |
| 4,295,503 | 10/1981 | Gilmour | 134/80 X |
| 4,834,123 | 5/1989 | McBrady | 134/159 X |
| 4,917,296 | 4/1990 | Konieczynski | 239/71 X |
| 5,135,014 | 8/1992 | Beswick | 134/62 X |
| 5,277,207 | 1/1994 | Perrier | 134/62 X |

FOREIGN PATENT DOCUMENTS

| | | | |
|---|---|---|---|
| 635493 | 9/1936 | Germany | 134/66 |

*Primary Examiner*—Philip R. Coe

*Attorney, Agent, or Firm*—Scully, Scott, Murphy & Presser

[57] ABSTRACT

A control system for a high-speed rotary washer spraying system designed particularly for plastic returnable bottles automatically regulates each process of the wash spraying system, namely, sequentially feeding bottles from an infeed conveyor means, inverting them by a worm/inverter means, receiving and simultaneously rotating each bottle in an inverted position through a plurality of washing, neutralizing and sanitizing treatment zones, and inverting each bottle to its original neck-up orientation for further processing. During the entire process, a programmable logic controller maintains, manages, and controls all pumps, valves, solenoids, and drive motor speeds as required by the process, and also provides for monitoring and adjusting fluid levels, alkalinity/acidity concentrations, and temperatures of the wash and neutralizing solutions. Alarm conditions that may present themselves during the washing, neutralizing, and sanitizing processes are flagged for human intervention, interaction, or acknowledgement. Such alarm conditions are out of range: fluid flow, temperature, pressure, conductivity and/or pH, fluid levels, and carousel and bottle RPM. The control system also includes specialized checks for clogged spray nozzles, and out of position fluid lances.

38 Claims, 11 Drawing Sheets

PLANT AIR IN
83
PLC

MAIN VACUUM
7.5 HP
77
78
74
STAR WHEEL 1
STAR WHEEL 2
STAR WHEEL 3
FROM FIG. 3C

TO MAIN VACUUM PUMP SEAL WATER
75
TO BOTTOM DISTIBUTORS & TIMING SCREWS
1/2
TREATED WATER

ROTATION DRIVE
0.5 HP
133A
133B
133C
133D
133E
135
134A
134B
134C
134D
134E
137
OUTFEED DRIVE
138
141
INEED DRIVE
136
131
CAROUSEL DRIVE
139
30 HP
140

ROTARY WASHER SPRAYING SYSTEM

FIELD OF THE INVENTION

The present invention generally relates to automatic rotary washer spraying systems and particularly, to a control system for a high-speed rotary plastic returnable bottle (PRB) washing and sanitizing system.

DESCRIPTION OF THE PRIOR ART

Existing machines for washing plastic returnable bottle (PRB) include one or more pre-treatment steps before carrying out an internal and/or external spray treatment. These pre-treatment steps usually include soaking each bottle in a water pre-softening bath or caustic solution pre-softening bath. The goal of pretreating each bottle is to remove coarse soils and residues from the beverages or products. Often these pre-softening steps are time-consuming and reduce the throughput desirable in high-output automatic PRB washing machines. Moreover, problems such as scuffing may occur as bottles in the bath brush up against each other or against the holders or cages in which they are transported. In addition, the pre-softening treatment with high-temperature baths may cause premature shrinkage of the PRB, or induce stress crack failure in non-oriented portions of the bottle. After pretreating, the PRB's are usually conveyed to an in-line or rotary carrier where they are held in place and subject to additional various external and internal spraying by additional detergents, air, and water.

Moreover, existing machines do not provide for the automatic control of the speed of conveyance of the bottles, the pH of the solutions, nor the temperatures and pressures of the wash solutions. Without adequate controls, insufficient washing and an increased likelihood of bottle rejection at the outfeed or discharge position of the machine will result.

SUMMARY OF THE INVENTION

Accordingly, it is a primary object of the present invention to provide a control system for a high-speed endless loop or in-line washer spraying system, and more particularly to a control system for a high-speed washer spraying system designed particularly for plastic returnable bottles. The control system automatically regulates each process of the wash spraying system, namely, sequentially feeding bottles from an infeed conveyor means, inverting them by a worm/inverter means, receiving and simultaneously rotating each bottle in an inverted position through a plurality of washing, neutralizing and sanitizing treatment zones, and inverting each bottle to the original neck-up orientation by an egress worm/inverter means and finally conveying them as a cleaned and sanitized bottle to another area for product refilling. The control system provides a plurality of treatment zones for the respective treatment by high-temperature caustic wash solutions, neutralizing solutions and sanitizing solutions, in addition to residual fluid removal and air drying fluids. The control system also actuates spray nozzles initially positioned externally of the bottle which are then driven into each bottle being cleaned. The spray nozzles for cleaning the interior of each bottle are specially designed to discharge jets of fluids in a unique pattern, such that in combination with the rotation of the bottle, effective cleaning by a combination of chemical dissolution and mechanical impingement is accomplished.

During the entire process, a programmable logic controller maintains, manages, and controls all pumps, valves, solenoids, and drive motor speeds as required by the process, and also provides for monitoring and adjusting fluid levels, alkalinity/acidity concentrations, and temperature of the recirculated wash solution. A machine operator or attendant may view from a centrally located operator interface, all of the above present machine operating and process parameters. Any alarm conditions that may present themselves during the process are displayed and will prompt for human intervention, interaction, or acknowledgement. Such alarm conditions are: out of range, fluid flow, temperature, pressure, conductivity and/or pH, fluid levels, carousel and bottle RPM, and will include specialized checks for clogged spray nozzles, and out of position fluid lances.

A further object of this invention is to provide a control system that enables the automatic self-cleaning of all the piping, valving, tanks, and wetted system components of the high-speed washer spraying system.

In accordance with the techniques herein, the present invention provides for a high-speed system for washing bottles that sequentially receives and rotates bottles in an inverted position, inserts a spray nozzle into each inverted rotating bottle for directing jets of at least a first fluid and a second fluid against an internal bottom portion and inner wall portion of the bottle for cleansing thereof, and controls the sequential discharge of at least the first fluid and second fluid from each of the nozzles for respective first and second predetermined periods of time and a predetermined pressures, wherein the first fluid is a high-temperature caustic wash solution for physically removing soils from the internal bottom portion of the bottle and chemically dissolving them. The second fluid is then caused to discharge from the spray nozzles to purge the interior and exterior of the bottle of the high temperature caustic wash solution.

DETAILED DESCRIPTION OF THE PREFERRED EMBODIMENT

PRB Washing and Sanitizing System

The automatic Plastic Returnable Bottle (PRB) washing and sanitizing system utilizes relatively commonplace bottle handling equipment such as conveyors, worm/inverters, starwheels, etc. and two specialized rotating horizontal carousel type wheels which hold the bottles in place for respective washing and sanitizing, as described in further detail in patent application Ser. No. 090,503, filed Jul. 13, 1993.

Bottle Flow Sequence

Figure 1:
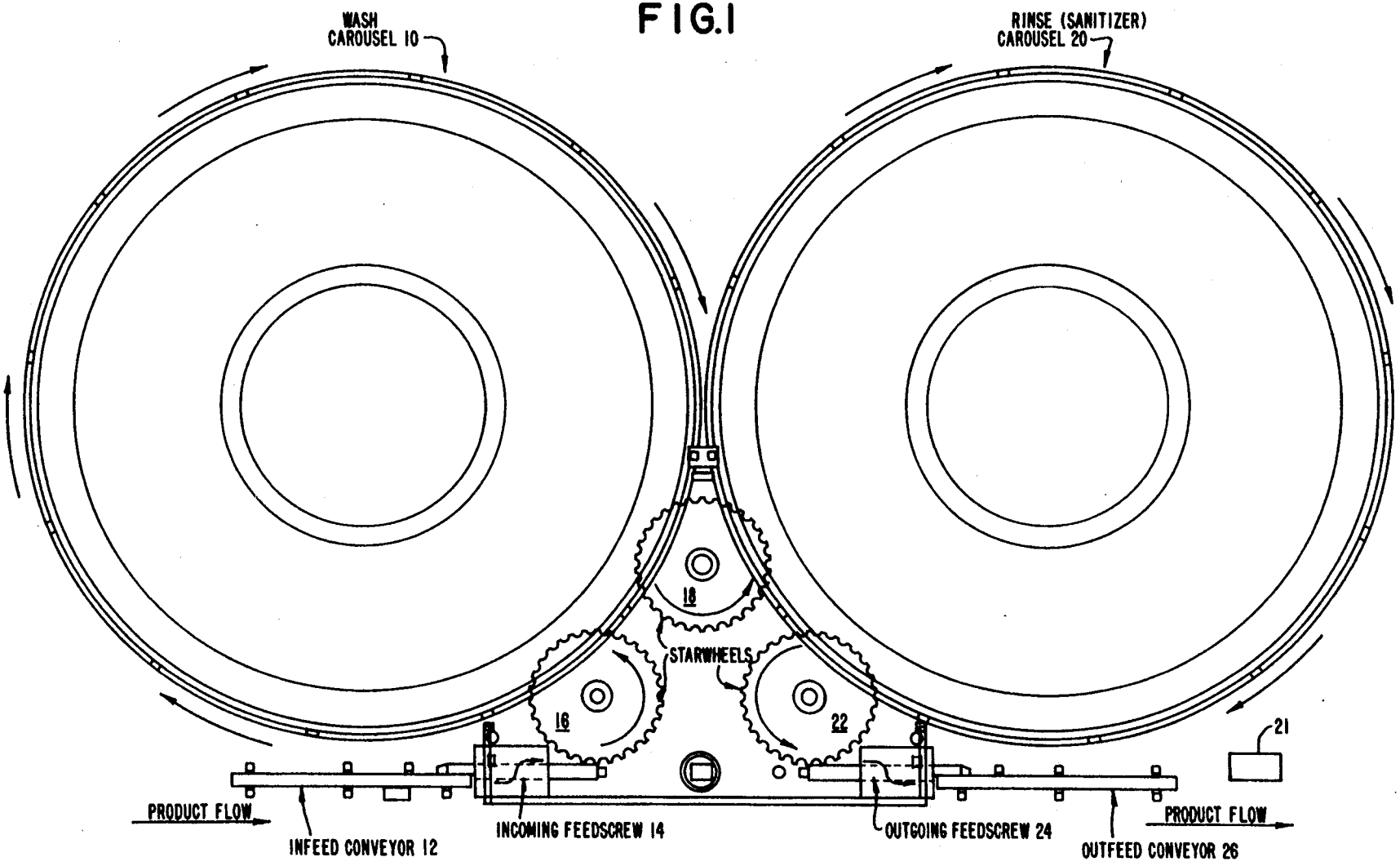
FIG. 1 illustrates a top plan view of one embodiment of a bottle washing and sanitizing machine.
Figure 2A:
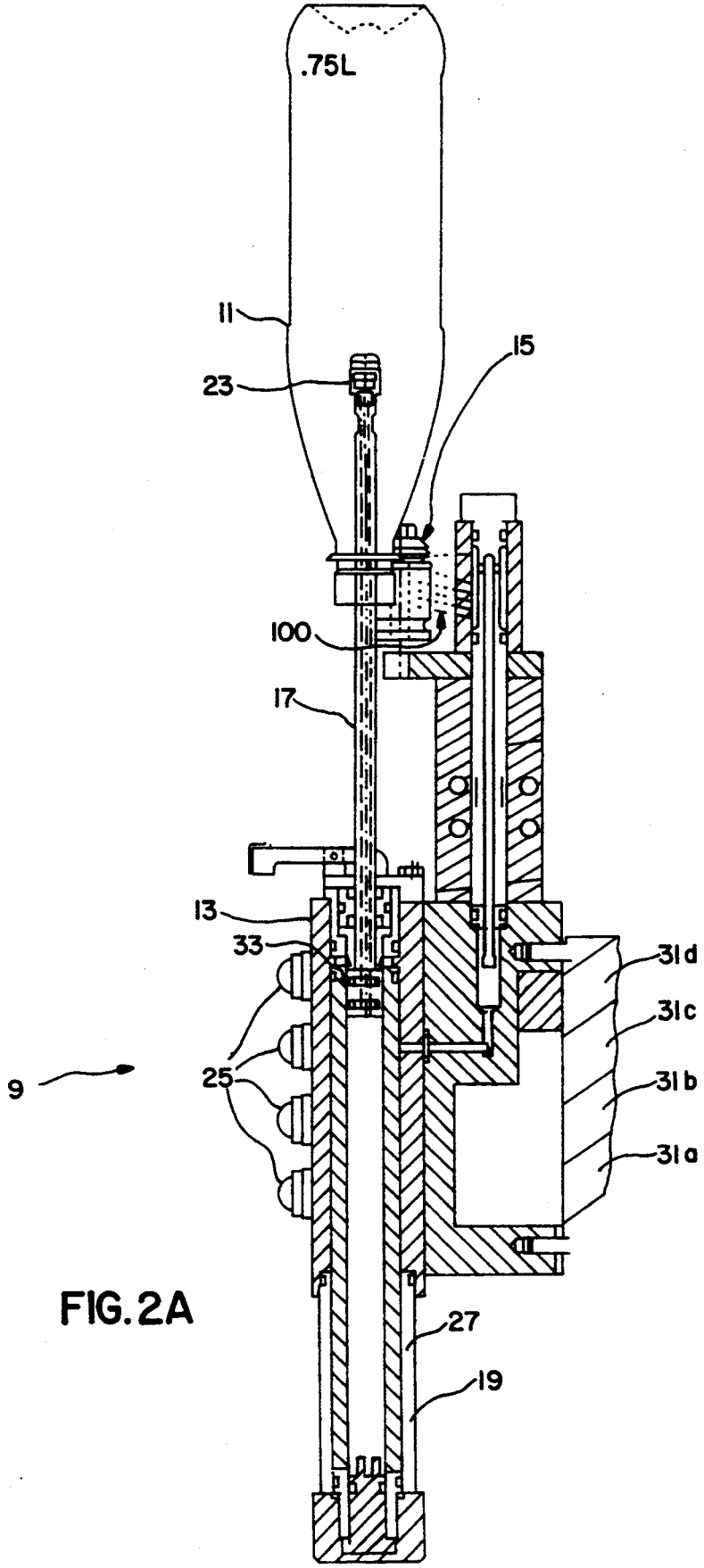
FIG. 2*a* is a view of the periphery of the wash carousel showing a PR bottle station including a bottle gripper device for holding a PRB in an inverted position.

Referring to FIG. 1, bottles enter a first wash carousel wheel 10 by an infeed conveyor 12, are inverted by a worm/inverter 14, and then proceed through a starwheel infeed device 16 which grips each inverted bottle by a vacuum holder. To minimize scuffing and abrasion to external bottle surfaces, the several devices are designed to handle the bottles with minimum mechanical contact, and are equipped with suction cups, vacuum nozzles, air jets, etc. to affect bottle conveying. The bottles are then transferred in a neck down position to an individual PRB station 9 in the wash carousel 10 as shown in FIG. 2*a*. A typical PR bottle station is provided with a manifold and valve block assembly 13 as described in further detail in patent application Ser. No. 090,511, filed Jul. 13, 1993. Generally, each manifold and valve assembly 13 comprises a valve block housing 27 in which a drive cylinder 19 is mounted. As shown in FIG. 2*a*, a lance 17 is longitudinally movably positioned within the drive cylinder 19, and has a central fluid flow passageway and a spray nozzle 23 mounted on an upper end thereof. The lance has a retracted position in which it is positioned fully retracted within the driving cylinder 19, and a fully extended position as shown in FIG. 2*a*, in which the fully extended lance positions the spray nozzle for spray impingement of a fluid through the nozzle. The lance is driven to its fully extended position by the pressure of the fluids supplied to the drive cylinder 19 that force the fluid driven piston 33 to travel an exact and precise distance within the confines of the bottle envelope. It subsequently is lowered or recalled by air pressure just prior to the bottle leaving each carousel.

A plurality of valves 25 are mounted in the valve block housing 27 for supplying a plurality of spray fluids to the manifold which provides a fluid passage to the central fluid flow passageway of the lance for the fluids to be sequentially sprayed through the nozzle. In greater particularity as illustrated in FIGS. 1 and 2*a*, each valve 25 is actuated by a corresponding cam track 29 predeterminedly positioned around the outer circumference of each carousel such that as the carousel rotates, a valve actuator for that valve is moved into contact with its associated cam track. Each carousel also includes a plurality of fluid supply annuluses 31 positioned around its inner circumference to supply fluid to each of the plurality of associated valves in the plurality of manifold and valve block assemblies positioned around the circumference of each carousel.

As shown in FIG. 2*a*, once the PR bottle 11 is transferred to an individual PR bottle station, it is gripped around its neck ring by neck ring gripper/rollers 15, as described in greater detail in patent application Ser. No. 090,413, filed Jul. 12, 1993, and held in position throughout its traversing the carousel. The neck ring gripper/rollers 15 are powered by drive motors and belts that impart a controlled spinning action to the bottle. The controlled spinning or rotation is very effective for both washing and sanitizing as it provides for maximum coverage of solutions at minimum volumes to both the external and internal surfaces of the bottle.

Figure 2B:
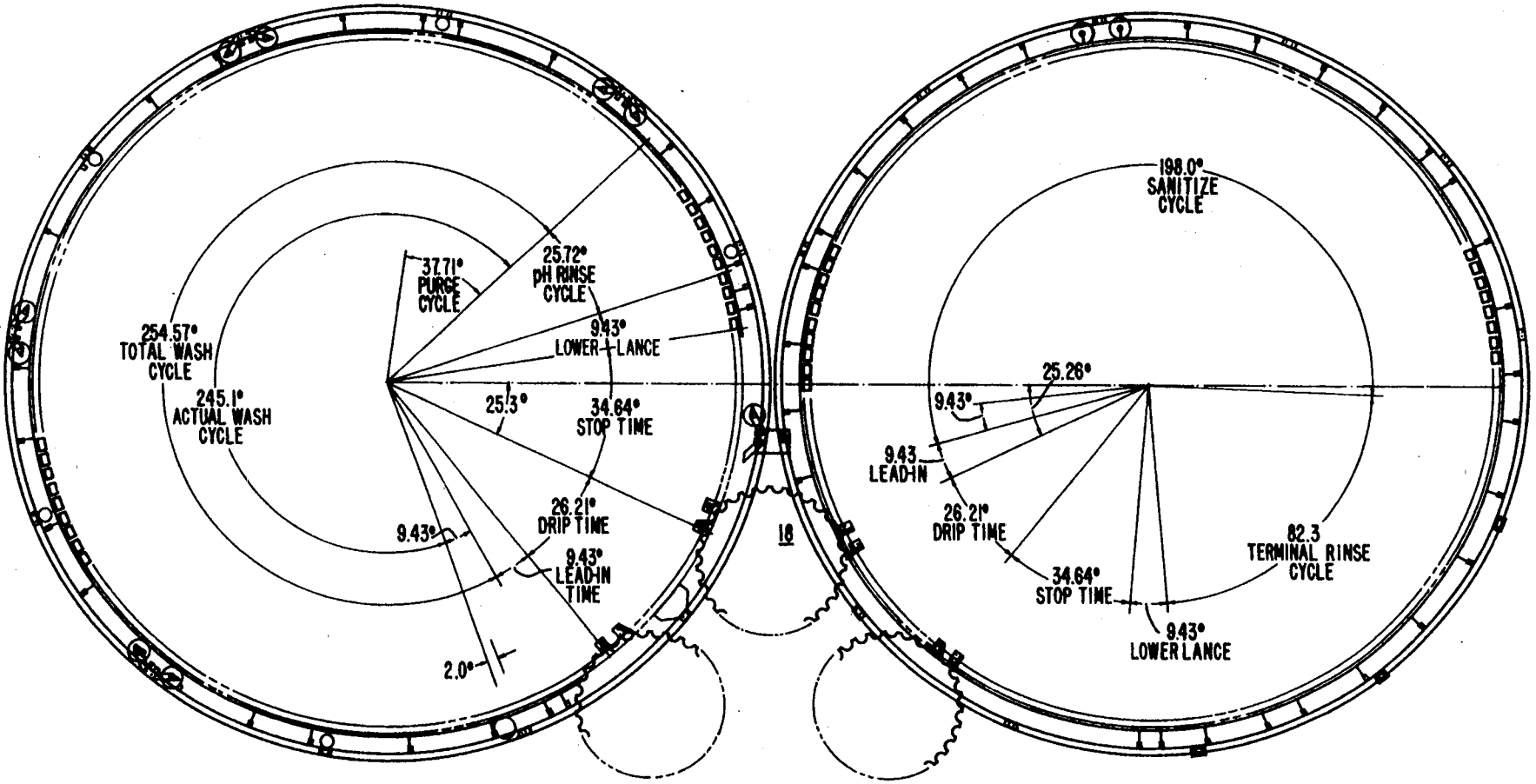
FIG. 2*b* is a plan view similar to FIG. 1 of the first wash carousel and the second sanitizing carousel, and illustrates the timing cycles of the two carousels.

FIG. 2*b* illustrates the following timed cycles or sequences by appropriate arcs around the first wash carousel and the second sanitizing rinse carousel. After a bottle is placed into the carousel, an initial 9.43 degree is a lead-in arc. During the next 9.43 degree arc, the lance with a spray nozzle at its tip is driven by fluid pressure in the drive cylinder 19 and inserted into each bottle as shown in FIG. 2*a*. As a bottle is conveyed through the next 236 degrees of the first wash carousel (after the lance is inserted), it is sprayed both internally and externally by a hot alkaline solution that solubilizes and removes typical soils found in returned used beverage bottles. One fluid supply annulus 31*a* supplies the hot alkaline wash solution under pressure to all alkaline wash solution valves in the plurality of manifold and block assemblies.

At the end of the 254 degrees conveyance (12 sec), 38 degrees (3 sec) of travel are allocated for an air purge/evacuation of residual alkaline solution within the bottle as shown in FIG. 2*b*. FIG. 2*a* shows another fluid supply annulus 31*b* in the wash carousel 10 that supplies purge air under pressure to a plurality of purge air valves in the plurality of manifold and block assemblies to purge an associated cylinder and common manifold of the alkaline wash solution currently therein which is sprayed through the spray nozzle followed by the purge air. With the lance still extended, this air purge is followed immediately by a neutralizing, slightly acidic rinse for a 26 degree duration. FIG. 2*a* shows another fluid supply 31*c* annulus in the wash carousel supplying an acid neutralizer under pressure to the plurality of acid neutralizer valves 25 in the plurality of manifold and block assemblies. FIG. 2*b* shows that immediately after the neutralizer rinse, the lance is lowered during a 9.43° arc. Another fluid supply annulus 31*d* in each carousel supplies static air under pressure to a plurality of static air valves in the plurality of manifold and valve block assemblies positioned around the carousel. The static air from each static air valve passes to the top of an associated lance in its fully extended position to pneumatically drive the lance downwardly to its fully retracted position. During retraction of each lance, a static air dump valve is opened simultaneously with the static air valve, which allows solution within the drive cylinder and common manifold to be evacuated.

The bottle is then transferred by a transfer starwheel 18 to a second sanitizer carousel 20 which is substantially identical in size and number of stations to the first carousel, and differs only slightly in structure from the wash carousel because of its different function. During conveyance by the second sanitizer carousel 20, the first 9.43° arc is allocated for lance raise time, followed by a 198 degrees arc allocated to the application of a sanitizing solution only to the interior of the bottle. One fluid supply annulus in the sanitizing carousel supplies sanitizing solution under pressure to a plurality of sanitizing solution valves in the plurality of manifold and block assemblies. This is followed by a final or terminal rinse of treated water applied to both internal and external bottle surfaces for approximately 82 degrees, followed by a 9.43° lance lower arc. Another fluid supply annulus in the second sanitizing carousel supplies treated soft water under pressure to a plurality of treated soft water valves in the plurality of manifold and block assemblies.

In both carousels, as a final treatment, free clean air is applied to blow off any residual liquids to provide maximum recovery and minimum migration of cleaning and sanitizing fluids.

The bottles are then removed from the rinse carousel by an outlet starwheel 22, and transferred to an outgoing feedscrew 24 which again inverts the bottle again to its original neck up position, from which it is conveyed at 26 as a cleaned and sanitized package to the product filler.

Figures 1, 3A:
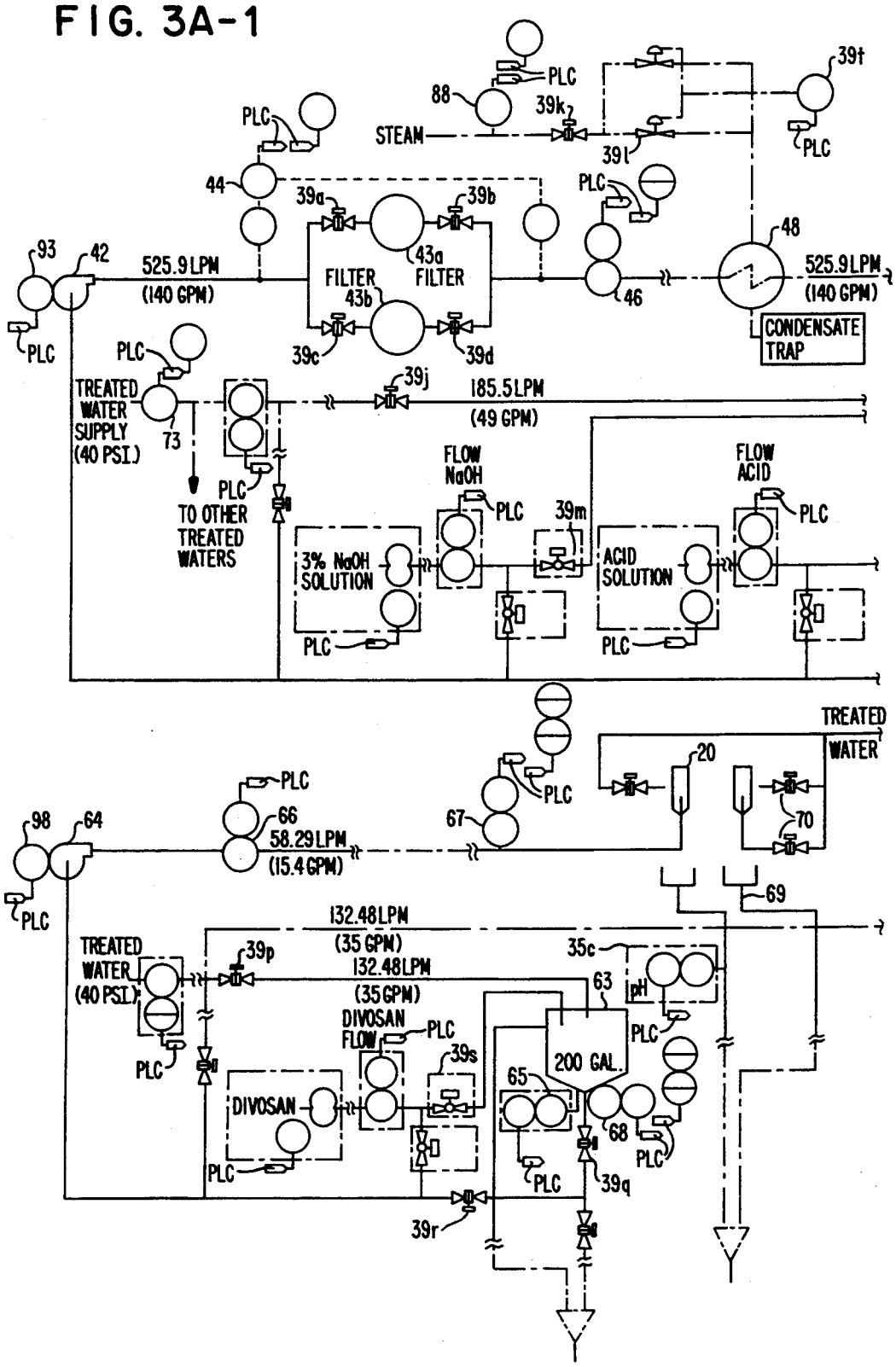
FIG. 3*a* is a piping and instrumentation diagram of the rotary washer spraying system of the present invention showing the system components that are monitored and controlled by the programmable logic controller (PLC).
Figures 2, 3A:
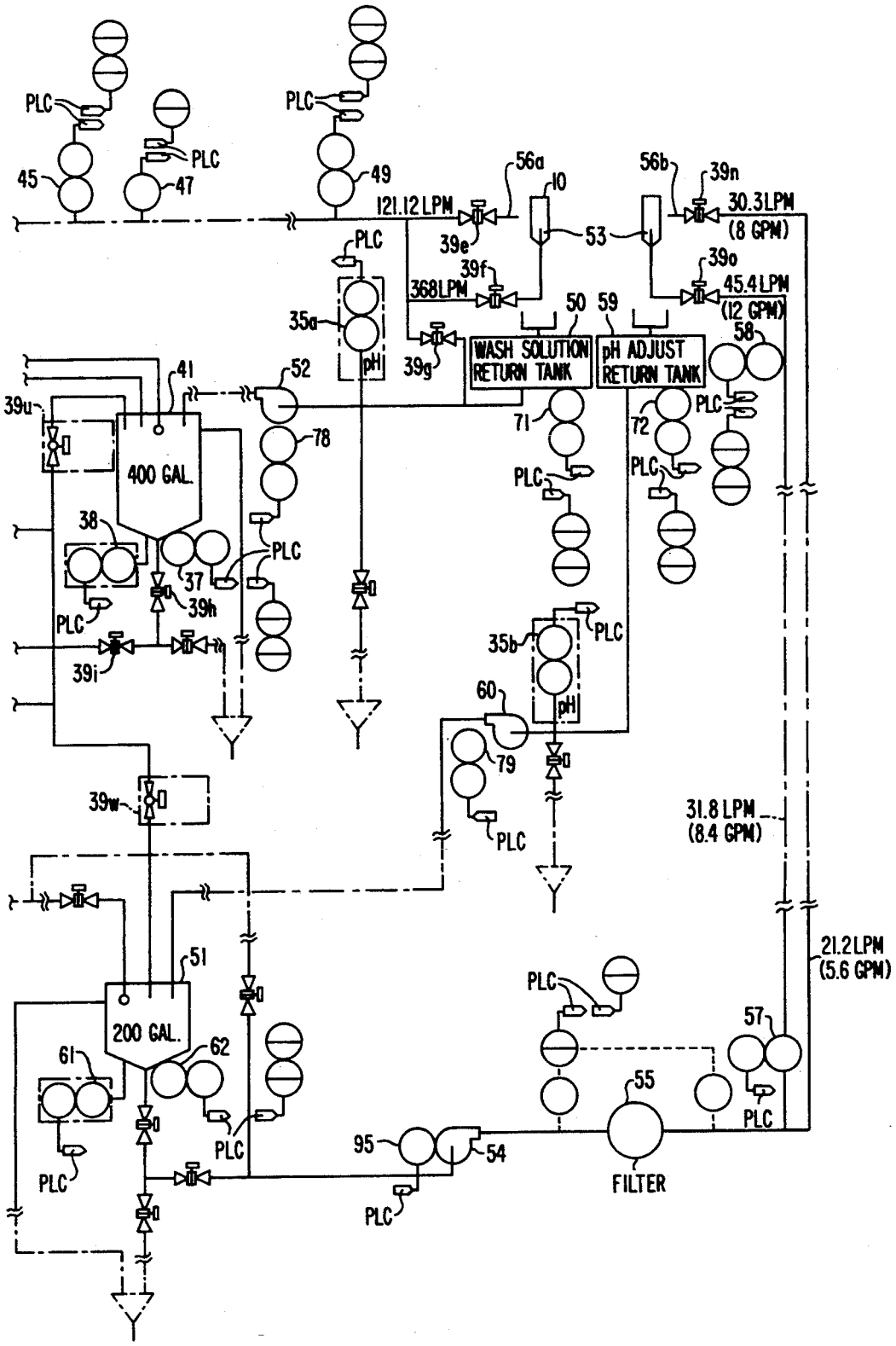

The physical layout of this rotary washer spraying system is illustrated in FIGS. 3*a*–3*d* which show the piping and instrumentation diagram of the washer spraying system explained in detail hereinbelow:

As mentioned above, the PRB is carried along the wash carousel 10 during the washing cycle. Wash solution fluid is pumped by fixed frequency drive pump 42 from a wash surge/supply tank 41 through one of two parallel mounted filters 46*a,b*, through a flow monitoring element 46, shell and tube heat exchanger 48, temperature sensing element 45, overtemp switch 47, pressure element 49, and valves 39*e*,39*f*, and 39*g* which provide for diversion of fluid flow when the wash carousel 10 is idling. As shown in FIG. 3*a*, all of the enumerated system components are connected to the control system PLC in a conventional manner for monitoring the system processes. The fluid is supplied to the external bottle spray header 56*a*, and to the wash carousel rotary union, wash solution supply annulus 31*a*, and finally through a valve and manifold 13 to the lance and interior spray nozzles 53. In the preferred embodiment, wash surge/supply tank 41 has a 400 gallon capacity, and contains a 3% NaOH alkaline solution. In the preferred embodiment, Divobrite ®, a commercially available alkaline wash solution having 3% NaOH and other wetting and suspension compounds, is used. Divobrite ®, is available commercially from Diversey Corporation, Wyandott, Mich. and has a pH of about 12.5. Additionally, the wash surge/supply tank 41 is provided with PLC connected pH/conductivity sensor 38 and fluid level sensor 37 for monitoring respectively, the pH and fluid level in the tank. In the preferred embodiment, all pH and conductivity sensors described herein are commercially available. Likewise, all fluid level sensors are commercially available.

Temperature sensing element 45 is provided to ensure that the wash solution remains at a precise temperature that will accomplish maximum cleansing without causing damage to the PR bottle or premature shrinkage thereof. A pressure differential element 44 examines the pressure on the inlet side of the dual filter 43*a,b* and compares that with the pressure on the outlet side of that filter. If the difference is too great, the filter is assumed to be near saturation, and valves 39*a* and 39*b* are simultaneously operated to shut off the first parallel filter 43*a* and to open valves 39*c* and 39*d* and the second parallel filter 43*b*, thus supplying a fresh filter without having to shut down the bottle washing operation. After acknowledging the clogged filter alarm, the machine operator cleans and replaces the saturated strainer filter for the next transition.

As the PR bottles are being washed in the wash carousel 10, the spent wash solution is gravitated to and collected by wash solution return tank 50 for recirculation. From wash return tank 50, the spent wash solution is pumped back via variable frequency pump 52 to wash surge/supply tank 41 to complete the wash recirculation circuit. Wash solution return tank 50 is provided with a fluid level sensor 71 and pH sensor 35*a* both of which are connected to the PLC for monitoring respectively the level of the recovered wash solution and its pH concentration. Fluid levels controls are provided for all solution carrying tanks to provide maximum efficiencies and economies against overusing the respective solutions.

As shown in FIG. 3*a*, the neutralizing rinse circuit for neutralizing the PR bottles after the wash treatment comprises a recirculated neutralizer surge/supply tank 51 for supplying a pH neutralizing solution to the wash carousel 10, a fluid pump 54 for pumping neutralizing solution from the rinse neutralizer surge/supply tank 51 to the wash carousel 10, through filter 55, flow element 57 for monitoring the fluid flow rate, and pressure element 58 for monitoring the pressure of the neutralizing solution supplied to the internal spray nozzles 53 and external spray nozzles 56*b*. In the preferred embodiment, recirculated neutralizer surge/supply tank 51 has a 200 gallon capacity and contains an acidic solution. In the preferred embodiment, Sentol ®, a commercially available acidic solution having a pH of about 2.5, is used. Sentol ®, is also available commercially from Diversey Corporation, Wyandott, Mich. and is supplied to the neutralizer surge/supply tank 51 via flow valve 39*w*. Additionally, the neutralizer tank 51 is provided with a pH sensor 61 and a fluid level sensor 62 for monitoring respectively, the pH concentration and the fluid level in the tank. As seen in FIG. 3*a*, all of these system components are connected to the PLC in a conventional manner for monitoring the system processes.

In the high speed bottle washing system, it is imperative that the bottles are neutralized by an acidic solution. The purpose of the neutralizing agent is to ameliorate the alkalinity of the bottle from the proceeding wash cycle because the efficacy of the sanitizer would be reduced if a bottle is transferred to the sanitizer carousel in a highly alkaline state. Hence, control of the pH concentration of the neutralizing solution is necessary.

As the PR bottles are being neutralized in the wash carousel 10, the spent neutralizing solution is gravitated to and collected by neutralizer collection tank 59. From neutralizer collection tank 59, the spent neutralizing solution is pumped back via variable frequency drive pump 60 to the reuse neutralizer surge/supply tank 51. Neutralizer collection tank 59 is provided with a fluid level sensor 72 and pH sensor 35*b* both connected to the PLC for monitoring respectively, the level of the recovered neutralize solution and its pH concentration.

The flow monitoring elements 46 and 57 in both the wash and neutralizing circuits are very sensitive flow measuring devices for measuring small differences in flow rates. In the preferred embodiment, all flow measuring devices described herein are commercially available. Should a nozzle in the wash carousel be plugged, the signal rate will be lower and, as will be explained in greater detail below, the suspect nozzle(s) is flagged and the identity of the nozzle station will be retained in PLC memory. That particular station or stations and more importantly, the location of the corresponding bottles, is retained in memory throughout the bottle flow sequence. Those bottles may then be rejected in subsequent bottle handling or inspection stations as being of uncertain quality.

After washing and neutralizing, the PRB is transferred to the sanitizing carousel 20 as previously described with respect to FIGS. 1 and 2*b*. Sanitizing of the interior of the PR bottles is necessary for disinfecting the bottle before conveying the PR bottle for refilling. As illustrated in FIG. 3*a*, fresh sanitizing solution is pumped via pump 64 from a sanitizing solution supply tank 63 through a flow monitoring element 66, pressure measuring element 67 for monitoring the pressure of the sanitizing solution, and to the sanitize carousel rotary union, sanitizer supply annulus, and finally through a valve and manifold to the lance and interior spray nozzles. As mentioned above, each of the enumerated system components are connected to the PLC in a conventional manner for monitoring the system processes. Flow element 66 is a very sensitive flow measuring device that detects small differences in flow rates. The tracking and rejection sequence will be explained in greater detail below.

The sanitizing carousel 20 duplicates in some respects the operation of the wash carousel with different solutions, temperatures, solution timings. In the preferred embodiment, fresh sanitizer surge/supply tank 63 has a 200 gallon capacity and contains a sanitizing solution comprising Divosan® which is supplied to it via adjustable valve 39*s*. Divosan® is a $HNO_3$ a solution containing iodine and is commercially available through and manufactured by Diversey Corporation, Wyandott, Mich. Additionally, the fresh sanitizer surge/supply tank 63 is provided with a PLC connected pH sensor 65 and a fluid level sensor 68 for respectively monitoring the pH concentration and the fluid level in the tank 63.

After sanitizing the interior of each PR bottle, both the internal and external surfaces are subject to a terminal rinse of treated water to remove any residual sanitizer from the preceding sanitizing step. As shown in FIG. 3*a*, treated water at a pressure of 40 psi is caused to flow through a series of valves 70 at the sanitize carousel 20, where the internal and external PRB surfaces are rinsed. All of the terminal rinse water (as well as spent sanitizer) in the sanitizer carousel collects in separate sanitize drain troughs 69 and gravity returns to a collection tank. Drain troughs 69 are provided with pH sensor 35*c* for measuring the pH concentration of the spent sanitize solution.

During the PR bottle flow sequence described hereinabove, the control system PLC maintains, manages, and controls each individual process e.g., carousel rotational speed, infeed/outfeed conveyors, bottle rotation drive motor speeds etc. Additionally, the control system PLC monitors and controls pumps, valves, solenoids and the starter motors required by the process. The control system PLC also provides for monitoring and adjusting fluid levels, alkalinity/acidity concentrations, and temperature of the wash solution. The general block diagram of the control system implemented by the control system PLC in the rotary washer spraying system is shown in FIGS. 4*a*–4*e* and a detailed discussion of the preferred embodiments are discussed below.

Control System

Figure 4A:
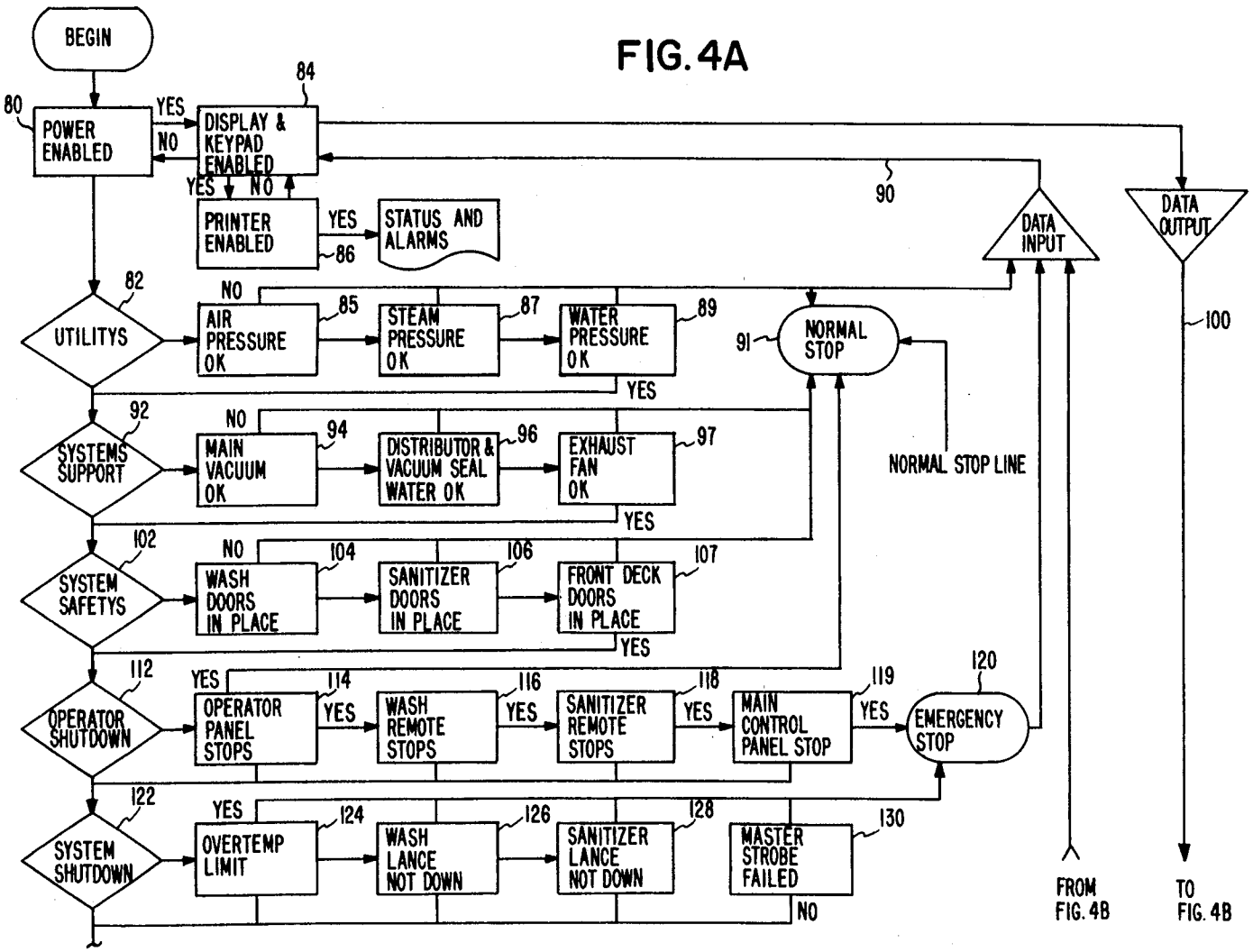
FIGS. 4*a*–4*e* show the sequential logic flow of the control system designed for the rotary washer spraying system of the instant invention.

From an offline state, power to the system components is enabled at step 80. At power up, the automated rotary washer spraying system will perform diagnostic checks to determine if all system components are present and operational. As shown in FIG. 4*a*, the sequentially performed diagnostic tests include a status check of all utility system components at step 82, a systems support check at step 92, safety systems check at step 102, operator shutdown check at step 112, and system shutdown check at step 122. Also upon power up, the operator display monitor and keyboard pad and the printer are respectively enabled at steps 84 and 86.

Figures 3B, 3C, 3D, 3E:
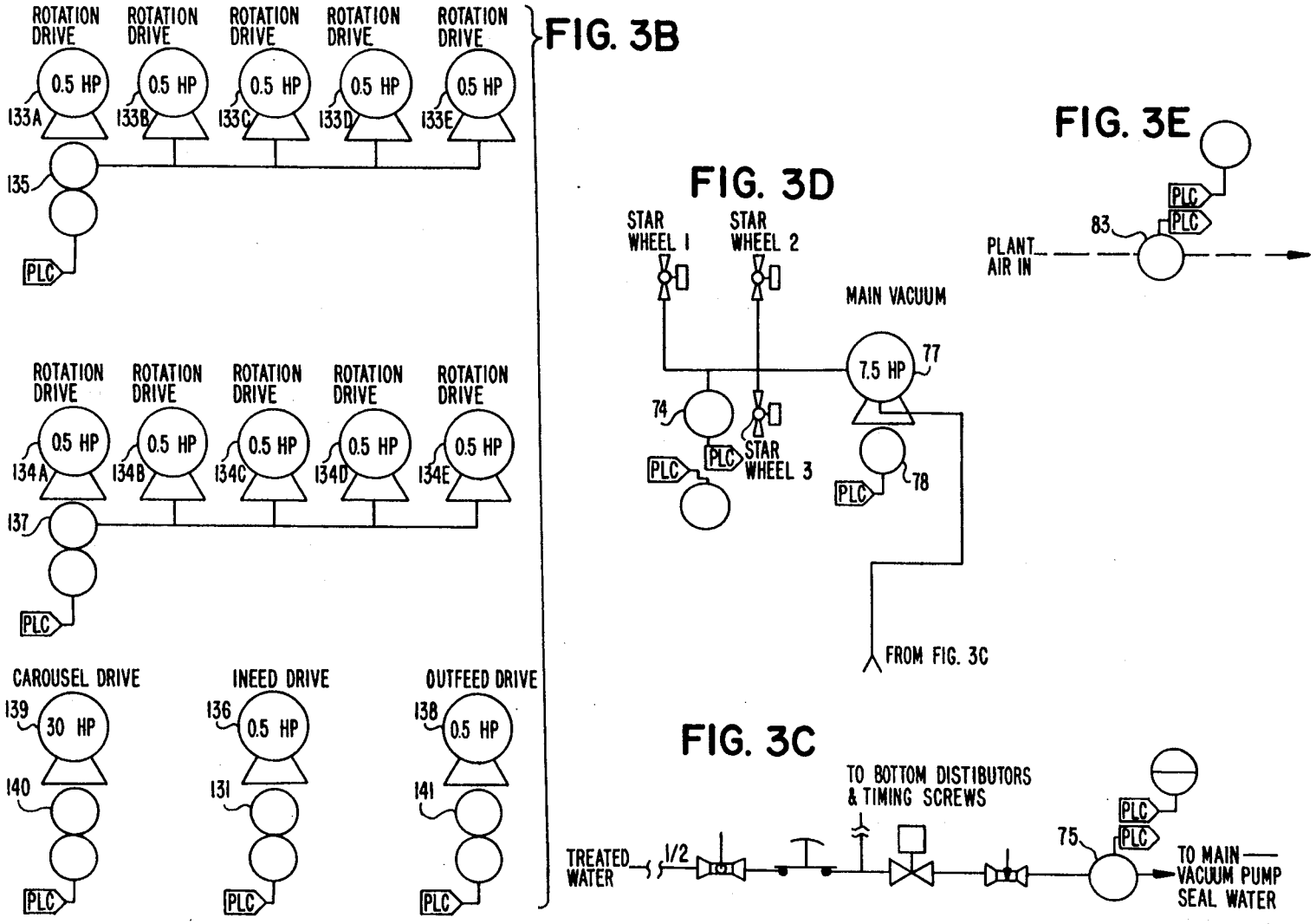
FIG. 3*b* illustrates the various drive motors that are used to provide automatic rotational and translational movement of the various system components and which are monitored and controlled by the control system PLC.
FIG. 3*c* illustrates the control element connected to the control system PLC that is used to monitor the vacuum pump seal water supplied to the main vacuum pump of FIG. 4*d*.
FIG. 3*d* illustrates the drive motor that is monitored and controlled by the control system PLC which supplies the main vacuum to the infeed, outfeed and transfer starwheels.
FIG. 3*e* illustrates the control element connected to the control system PLC that is used to monitor the air pressure supplied to the system.

As shown in FIG. 4*a*, the utility components diagnostics (step 82) include a check of the air pressure system at step 85, the steam pressure system check at step 87, and water pressure system check at step 89. Particularly, each diagnostic will check that the respective pressures are within their desired ranges. As shown in FIG. 3*e*, pressure sensor element 83 connected to the control system PLC will monitor the plant air pressure that supplies the static air for retracting the fluid lance 17. In FIG. 3*a*, steam pressure sensor element 88 monitors the steam pressure supplied to the system. In addition, water pressure sensor 73 connected to the control system PLC will monitor the pressure of the treated water supplied to the system. Whenever any of these respective utility pressures are out of range, a normal stop condition 91 exists and an alarm signal will be generated and sent through the data input bus 90 for display and the diagnostics will stop. An operator at that point may take appropriate action to rectify any problems in the utility systems. If the utilities are operational, the system proceeds to check the systems support components (step 92).

The system support diagnostics includes a check of the main vacuum at step 94, distributor and vacuum seal water check at step 96, and exhaust fans check at step 97. As shown in FIG. 3*d*, main vacuum pump 77 which creates the main vacuum for starwheels 16,18, and 22, is provided with a pressure sensor 74 to monitor the main vacuum manifold. Similarly, as shown in FIG. 3*c*, the flow sensor 75 will check that the vacuum pump seal water is supplied to the main vacuum pump 77. If these components are not operational as determined by the control system PLC, the diagnostics will stop and an appropriate message displayed for operator intervention. If these components are present, a safety systems check is performed (step 102). This diagnostic will check that the wash doors, at step 104, sanitizer doors, at step 106, and front deck doors at step 107, are closed, secured, and in place. If these components are not present or secured, the diagnostics will stop and an appropriate message displayed for operator intervention. If the safety system components are present the diagnostics will continue to check the status of operator enabled shut down stops (step 112) which include the operator panel stops check at step 114, the wash remote stops at step 116, sanitizer remote stops 118, and main control panel stop at step 119. If any one of the operator panel, wash remote and sanitizer remote stops are activated by the operator, an emergency stop condition 120 exists and the system will stop. When the main control panel stop 119 and an emergency stop 120 is activated, the system will stop and an appropriate message signal will be generated and sent through the data input bus 90 for operator confirmation.

If the operator shutdown stops are not activated, a diagnostic test is performed on the system shutdown components at step 122 to determine their status.

The system shutdown diagnostic includes a check at step 124 to determine if the overtemp limit switch 47 is activated, and whether any wash lances (step 126) and sanitizer lances (step 128) are in their extended positions. If the overtemp limit switch 47 is activated or if any wash or sanitize lances are not retracted as determined by proximity sensors (not shown), the emergency stop will be triggered at step 120 and an appropriate alarm signal will be generated and a message displayed for operator intervention. Furthermore, the status of the master strobe will be checked at step 130. The master strobe is the trigger used for counting and tracking each bottle input to the system. If the master strobe diagnostic fails, again the emergency stop 120 is triggered and an appropriate display will be generated. If the master strobe is functional, the power enable diagnostics test will continue as shown in FIG. 4*b*.

Figure 4B:
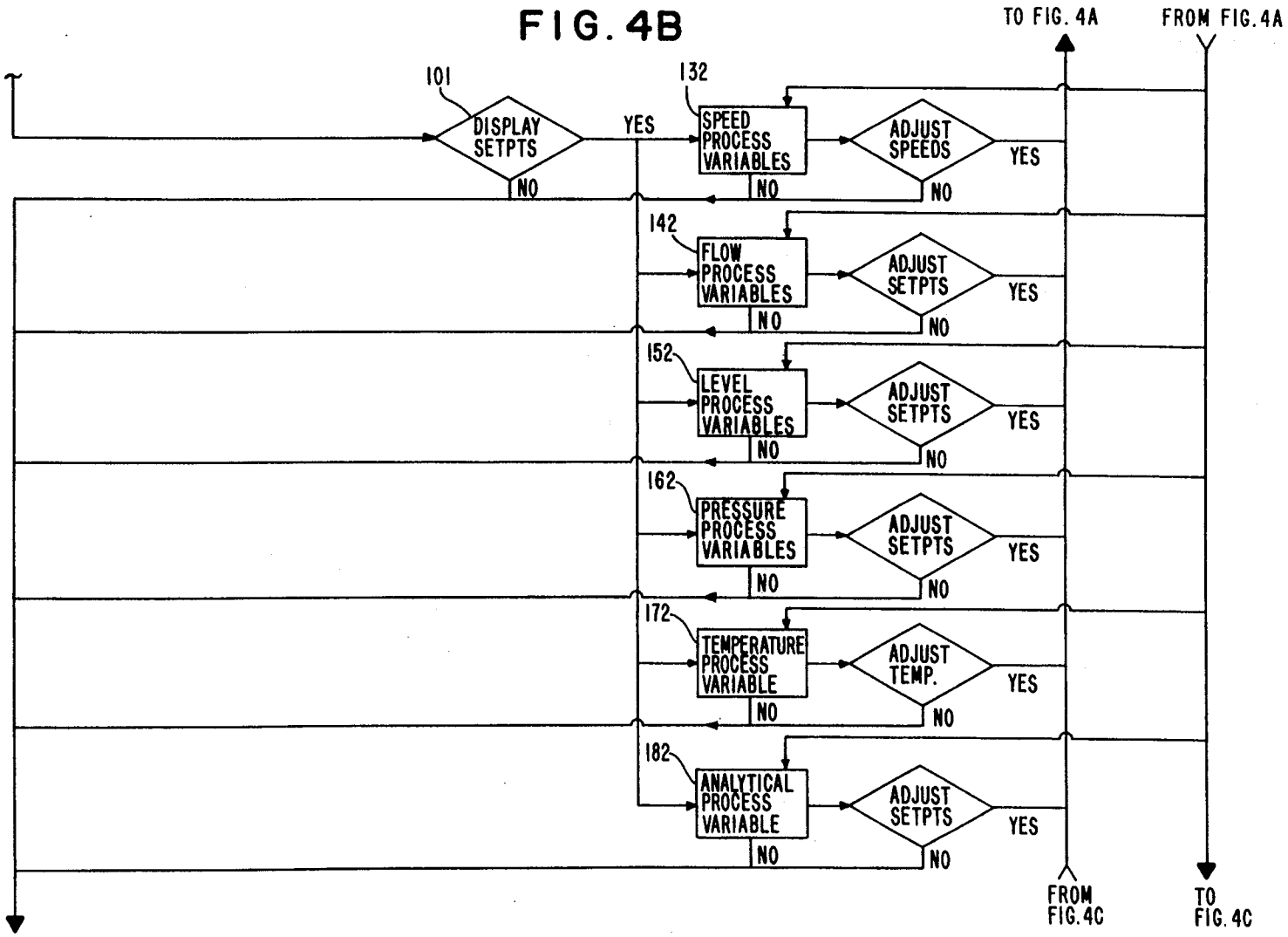

FIG. 4*b* illustrates how various process variable setpoints may be adjusted after the status of the various system components discussed above are verified. The operator of FIG. 1 may request a display (step 101) of the motor speed 132, flow 142, level 152, pressure 162, temperature 172, and analytical 182 process variable setpoints. These process variable setpoints are the range limits for the processes to be controlled and monitored by the PLC in the system. In the preferred embodiment, absolute setpoint limits for each process are programmed in the PLC so that an operator may not set ranges above or below the setpoint limits. It should be understood in view of FIG. 4*a* that all operator keypad requests and entries to change the process variable setpoints are generated from the keypad and display 84 and output via data output bus 100 to the PLC.

When desired, the operator may set or adjust the speed process variables at step 132. The speed process variables are the speeds of the various drive motors and variable frequency pumps. FIG. 3b illustrates a bank of five rotation drive motors 133*a*– 133*e*, of preferably 0.5 HP each, which drive the bottle spinning belts for the wash carousel 10. Another bank of five rotation drive motors of 0.5 HP each 134*a*–134*e* drive the bottle spinning belts in the sanitize carousel 20. As shown therein, motor speed sensor elements 135 and 137 are hardwired to the PLC to monitor the current operating speeds and receive instructions from data output bus 100 to automatically change the speed of the respective motor bank. In other embodiments, the speed of each individual drive motor may be controlled separately. The speed setpoints for the 30 HP primary drive motor 139 may also be programmed in the control system PLC. Motor speed control element 140 connected to the PLC, monitors the rotational speed of each wash and sanitize carousel. In the preferred embodiment, each carousel rotates at a speed of 2–3 rpm. Other speed process variables to be controlled and monitored by the PLC include the drive motors 136, 138 for the infeed conveyor and outfeed conveyor. Preferably, these motors are 0.5 HP each and are provided respectively with motor speed control elements 131, and 141. The speed of the variable frequency pumps 52 and 60 of FIG. 3*a* are also monitored by the PLC via respective connections to motor speed control sensors 78 and 79. It should be understood that if any of these drive motor or variable pump speeds fall above or below the programmed setpoints, the PLC will trigger an alarm and an appropriate message will be displayed.

The next process variable setpoints to be displayed and/or adjusted are the flow process variables at step 142. FIG. 3*a* shows flow elements 46, 57 and 66 are connected to the control system PLC to monitor the flow of solutions supplied to the wash and sanitize carousels. Flow element 66 monitors the flow of sanitizing solution to the sanitize carousel 20, and flow elements 46 and 57 respectively monitors the flow of wash solution and neutralizer to the wash carousel 10. When the system is running, the preferred flow rates for the sanitizer solution ranges from 35.0 L/min. to 75.0 L/min. The preferred flow rate for the wash solution ranges from 250 L/m to 750 L/m and the flow rate for neutralizer solution ranges from 25.0 L/min. to 40.0 L/min. If the flow rates of the respective solutions vary from the preset rates, an alarm condition will exist and a message will be displayed to the operator.

The setpoints for the level process variables may be programmed next at step 152. As shown in FIG. 3*a*, fluid level sensor elements 37, 62 and 68 provided in the system are connected to the PLC to monitor the levels of the solutions in the wash, neutralizer, and sanitize tanks. Elements 71 and 72 monitor the solution levels with the recirculated wash solution return tank 50 and neutralizer collection return tank 59 respectively. When the solution levels in these tanks exceed or fall below acceptable limits, an alarm condition will exist and an appropriate message will be displayed for the operator.

The temperature process variable setpoints may also be programmed and adjusted at step 172. As shown in FIG. 3*a*, temperature element 45 is connected to the PLC and monitors the temperature of the wash solution supplied to wash carousel 10 as shown in FIG. 3*a*. If the temperature of the wash solution varies from the nominal 140° F., the amount of the steam supplied to the heat exchanger 48 will be adjusted accordingly by valve 39L. Over temperature limit switch 47 is hardwired to the automatic safety shutoff valve 39*k* which will shut off the steam and provide an alarm signal when the temperature of the wash solution exceeds 145° F.

The pressure process variable setpoints may be adjusted next at step 162. These setpoints regulate the pressure for each of the solutions supplied to the carousels as well as the steam pressure, air pressure and treated water pressure. As shown in FIG. 3*a*, pressure transducer 49 is connected to the PLC and monitors the pressure of the wash solution supplied to the wash carousel. Likewise, pressure transducer 58 monitors the pressure of neutralizing solution supplied to the wash carousel, and pressure transducer 67 monitors the pressure of the sanitize solution supplied to the sanitize carousel 20. In the preferred embodiments, all solutions are programmed to flow under a pressure of 40 psi. Also connected to the PLC are pressure transducers 73,83, and 88 that monitor respectively the system water and air pressures supplied at 40 psi, and steam pressures supplied at 65 psi. If the current values of any of the monitored pressures are out of range, an alarm condition will exist and an appropriate message displayed.

The analytical process variable setpoints may be adjusted next at step 182 as shown in FIG. 4*b*. The pH/conductivity sensors 38, 61, 65 are each connected to the PLC as shown in FIG. 3*a*. The pH of the wash solution ranges from 12.0 to 13.0 and its conductivity ranges from 0–5%. The pH of the neutralizing solution ranges from 2.0 to 4.0 If the current measured pH value of any solution exceeds the programmed or nominal value the pH of that solution will accordingly be adjusted automatically. The pH of the spent wash solution is monitored by pH sensor 35*a* and the pH of the spent neutralizer and sanitizer solutions are monitored by pH sensors 35*b* and 35*c*.

It should be understood from FIG. 4*b*, that all operate adjusted process variable setpoints, speeds and temperatures are input via the data input bus 90 to the operator keypad and display. The data output bus 100 provides the setpoint information to the PLC.

Figure 4C:
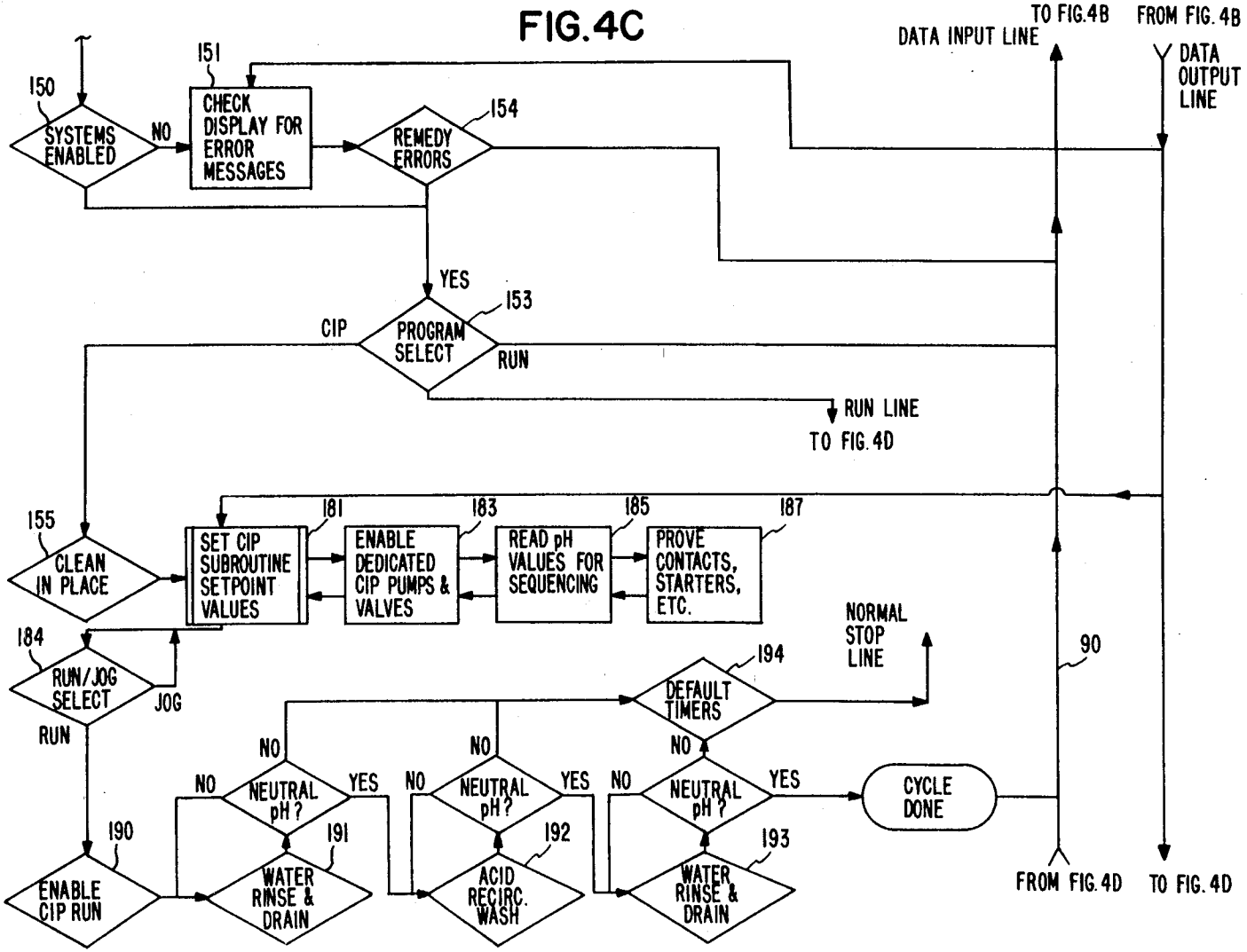

Once the diagnostics are performed and the variable setpoints are established, all systems are enabled at step 150 as shown in FIG. 4*c*. If an error had been found during the diagnostics check, the error messages will be displayed at step 151 and the operator will be prompted to remedy the errors at step 154. Once remedied, the operator at step 153 can choose to enter the clean in place (CIP) mode 155 or the normal PRB wash/sanitize run mode 160 of FIG. 4*d*.

RUN MODE

Figure 4D:
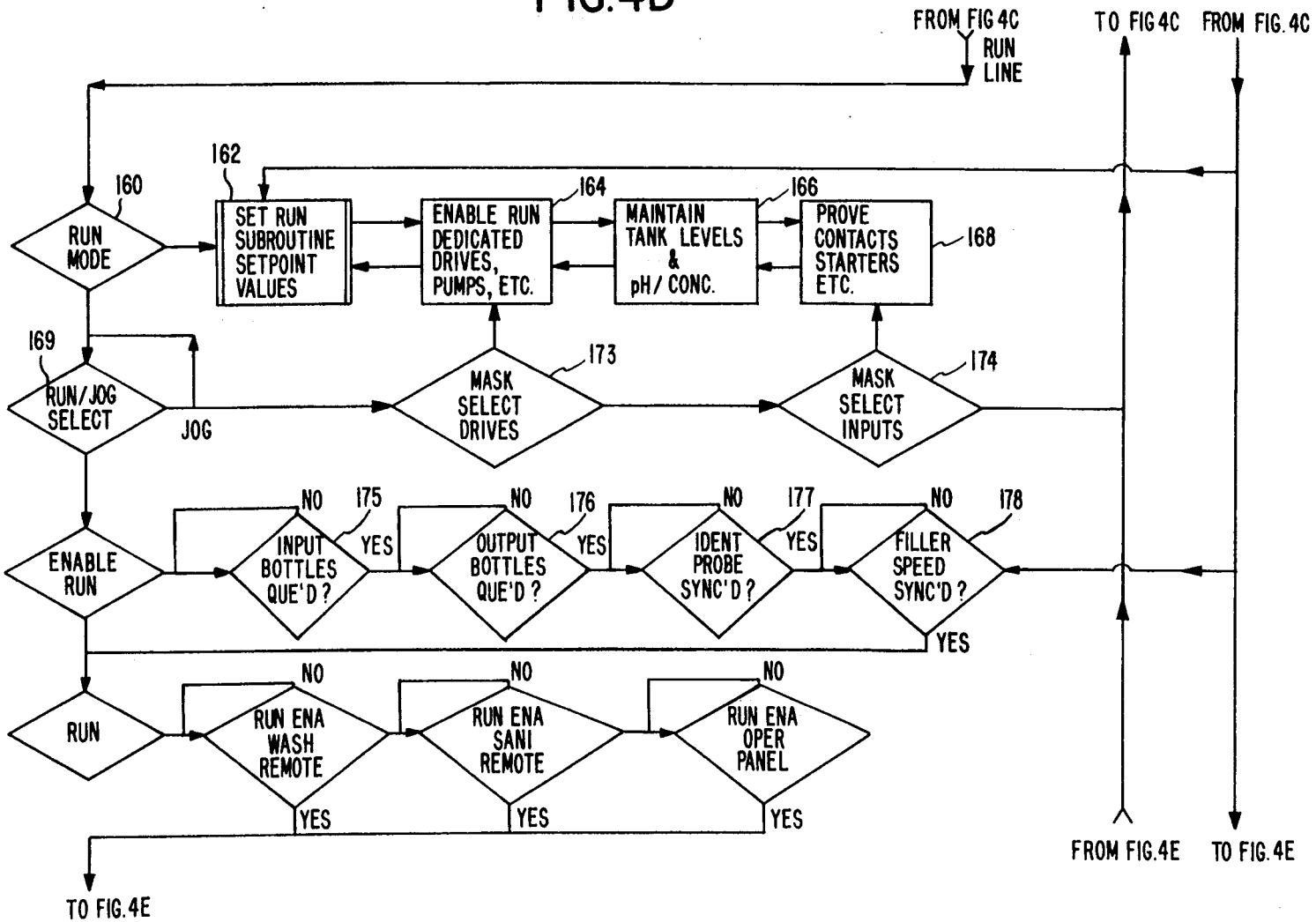

When the run mode 160 is selected, a first set of parallel operations are concurrently executed as shown in FIG. 4*d*. These operations include setting the run subroutine setpoint values at step 161, enabling the dedicated motor drives and pumps at step 164, maintaining the proper fluid levels in the tanks and the proper pH/conductivity of the solutions at step 166, and to prove the contacts and starters at step 168. At step 169 an operator may enable Jog option switch to reduce the motor drive speeds to 20% and to perform maintenance by mask selecting the dedicated drives at step 173 and mask selecting the contacts and starters at step 174.

In the run mode at step 162, the run subroutine setpoint values described above are input from the data output bus 100. At step 164, the dedicated drives and pumps are enabled and all of the wash circuit start-up routines and batch fill routines are actuated. As shown in FIG. 3*a*, the wash circuit startup includes enabling filter 43*a* and 43*b* and adjusting solution flow valves 39*a*–39*j* to enable flow of wash solution to the wash carousel 10, and enabling the flow of steam via pneumatically operated control valves 39*k*, 39L driven by current to pressure transducer 39*t* to the heat exchanger 43. Flow valve 39*m* is also adjusted to provide a flow of the NaOH solution to the fill wash surge/supply tank 41 if the level of the tank is under 20% full. The valves 39*n* and 39*o* are adjusted to provide neutralize solution to the external and internal spray nozzles in the wash carousel.

In the sanitize circuit, valves 39*p*–39*r* enable the flow of sanitizing solution from the sanitizing solution supply tank 63 to the lances and spray nozzles of the sanitize carousel 20. Flow valve 39*s* enables the flow of Divosan® to the sanitize supply tank.

The wash startup routine also includes enabling the vacuum and conveyor motors and pumps at step 164. Main vacuum pump starter 78 shown in FIG. 3*d* are actuated as are the starters 93,95, and 98 for the respective fluid pumps 42,54, and 64. Also enabled at step 164 are the run infeed and run outfeed drive conveyors. While in the run mode, the real time maintenance of the solution tank fill level and pH concentrations are provided by the PLC as shown as step 166 in FIG. 4*d*.

To ensure proper functioning of the rotary washer spraying system, the parallel checks are made to ensure that the PR bottles input to the infeed conveyor at step 175 are synchronized with the discharge of bottles at the output conveyor (step 176). Furthermore, continuous checks are made at step 178 to ensure that they both are in synchronization with the rotation of the carousels and with the speed of the downstream bottle filler. In the preferred embodiment, the carousel speeds are controlled to produce cleaned and sanitized bottles to a downstream filler at a rate of 440 bottles/min. Additionally, a check is made at step 177 to ensure that the each lance and spray nozzle is synched for input to each PR bottle input.

Figure 4E:
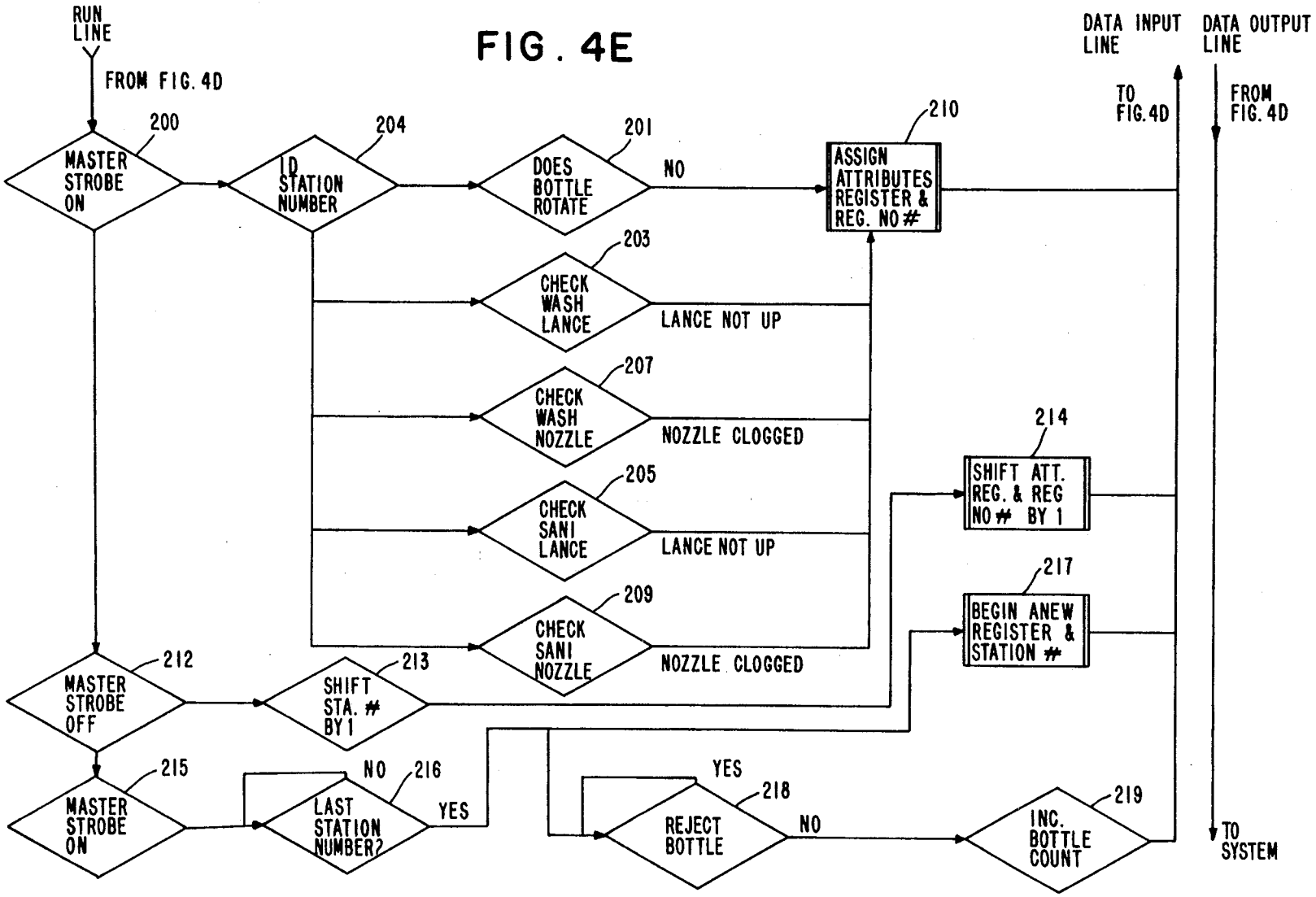

The PLC of the rotary spray washer system is programmed to perform a specialized check for determining when a spray nozzle is clogged or when a spray lance carrying the spray nozzle has not been inserted in the PRB. FIG. 4*e* shows the process implemented by the PLC for tracking PRB stations that contain a clogged spray nozzle, inoperable spray lance, or, has a bottle holding device that doesn't rotate at the preferred rate of 10–12 r.p.m. The bottles carried by these tracked stations will be deemed as being of uncertain quality and ultimately rejected by a suitable rejection device 21 located at the outfeed conveyor or at a bottle inspection station mounted downstream of the washer system.

At step 200 shown in FIG. 4*e*, the master strobe 200 and an associated counter is reset before the first bottle is input to the wash carousel. A count is maintained by a counter which corresponds to the bottle station number. For instance, the bottle station receiving the first PR bottle is PR bottle station number one (1), and will be identified as such throughout the bottle's conveyance. The counter increments by one for each bottle input until the first bottle input is discharged at the outfeed conveyor. A position number is assigned for each bottle position located about the periphery of the carousel. Therefore, all bottles are input to the carousel at position one (1). When the second bottle is input at position 1 the first bottle is located at position two (2) etc.

Each PRB station number also has assigned attribute registers resident in PLC memory, that stores information or data corresponding to the station attributes. In the preferred embodiment, bottle station attributes include data indicating whether the particular bottle is rotating, whether the wash and sanitize spray lances are inserted in the inverted bottles, and whether the wash and sanitize spray nozzles have been clogged. These attributes indicate that the PR bottle carried by the station is of uncertain quality and should be discarded at the output. In other embodiments, other types of attribute data may be assigned to the appropriate attribute registers.

After each stroke, all PR bottle station attribute checks are performed at each position along the wash and sanitize carousels, and the transfer starwheel. First, an identification of the particular bottle station being checked is identified as shown in step 204 in FIG. 4*e*. This is accomplished by knowing the position number and the current count of the counter. Then, at each identified position, a check is made at step 201 to ensure that each bottle is rotating at the corresponding PRB station. In addition, checks are performed by appropriate motion sensors or proximity sensors located each carousel position to ensure that wash spray lances are fully extended at step 203 and that sanitizing spray lances are extended at step 205.

If an attribute at a particular station is bad, e.g., spray lance not up, then at step 210, the information will be sent to attribute registers associated with the identified station in PLC memory.

The checks for clogged spray nozzles for stations in the wash carousel (step 207) and in the sanitizer carousel (step 209) are likewise determined at each position in the following manner: The normal flow rate for ten (10) spray nozzles, as measured by analog flow sensors 46 and 57, is 34.5 liters/min. in the preferred embodiment. This amount corresponds to a predetermined binary number implemented as counts of an A/D converter which may be part of or connected to the flow sensor. In the preferred embodiment, a flow rate of 34.5 liters/-min. corresponds to 8300 counts of the A/D converter. Since each spray nozzle passes about 0.5 liters/min., a flow rate of 10 lances with one clogged nozzle is 34 liters/min., or 7864 counts of the A/D converter. Therefore, to detect one or more plugged nozzles, the flow rate will have to be at least 436 less than the previous value.

Example 1 illustrates how a clogged nozzle is determined: As described above, the flow sensors can only measure flow rates for ten (10) lances at a time. If the flow rate for the first ten bottles input and conveyed to PRB positions 1–10 is normal, i.e., 8300 counts of the A/D converter, and the flow rate measured when the 11th bottle input is 436 less than the previous count, then the spray nozzle at PRB station number 11 (at position 1) must be clogged because it was previously determined that bottle 1 through 10 had no clogged nozzles. Consequently, data indicating a clogged spray nozzle will be assigned to the attribute register corresponding to PRB station number 11. Bottle 11 will subsequently be discharged at the output.

Assigning the data to the attribute registers corresponding to a particular PRB station is shown as step 210 in FIG. 4*e*. By knowing the master strobe count and the station position about the carousel, the identification of the particular PRB station having a bad attribute is easily determined. After the attribute checks are made, the master strobe is turned off (step 212) and the next bottle is input to the next bottle station. Concurrently, the station number is incremented by 1 (step 213) as is the pointer to the attribute registers (step 214). The master strobe is then initiated again (step 215) and a check is made to determine if the last station has received a bottle, i.e., the last station number had been reached (step 216). If the last station number has not been reached, then the process is repeated PRB station attribute checks are made at all positions about the carousel until a new bottle is input to the next station (step 217). If the last station number was reached, then the first bottle input (station one) is ready for discharge at the egress starwheel and outfeed conveyor. A check is then made to the attribute registers associated with the bottle ready for discharge to determine if any bad attributes exist. If a bad attribute is found, then the bottle will be rejected (step 218) by discharge means 21 located at the output conveyor or at a bottle inspection station mounted downstream of the washing system. If no bad attributes are found in the attribute registers associated with the bottle to be discharged, then the bottle may be conveyed downstream for product filling. Finally, the bottle count is incremented (step 219) and the process repeats itself for as long as the machine is in the run mode.

CLEAN IN PLACE

The Clean in Place (CIP) is a separate program resident within the PLC that is switch selectable from the operator panel. This program is called into play immediately after the system is closed down for any extended period of time, e.g. overnight. The CIP is also invoked on a daily basis to avoid a calcification or a buildup of insoluble carbonates and other precipitates that result from the interaction of the caustic solution with metal ions such as calcium or magnesium that occur naturally in water. Thus, CIP is invoked to prevent inefficient bottle cleaning due to blockage of the spray nozzles due to a precipitates which may accumulate over time.

The CIP mode 155 is selected at step 153 shown in FIG. 4*c*. As in the run mode discussed above, a first set of parallel operations are concurrently executed. These operations include setting the run subroutine setpoint values at step 181, enabling the dedicated motor drives and pumps at step 183, maintaining the proper fluid levels in the tanks and the proper pH/conductivity at step 185, and to prove the contacts and starters at step 187. A Jog option switch may be enabled at step 189 to reduce the drive speeds to 20% and to perform any required maintenance. The run subroutine setpoint values inputs at step 181 the setpoint values from the data output bus 100.

When CIP run is enabled at step 190, the program executes three cycles: a water rinse and drain cycle at step 191, an acidic recirculation wash at step 192, and a final water rinse and drain cycle at step 193. Each of these cycles are sequentially executed in a timed manner as programmed by default timers 194. As shown in FIG. 3*a*, treated water is supplied to wash solution surge/supply tank 41 through flow valve 39*j*. The acid recirculation wash is supplied to the wash solution tank 41 via flow valve 39*u*. For each cycle, if a neutral pH reading of the collected CIP solutions is not achieved, as measured by the pH sensor 35 in the wash recirculation circuit, a normal stop condition will exist. If neutral pH readings are achieved within the default times, then the CIP is complete and an appropriate message displayed via data input line 90.

Manual intervention is required prior to running CIP. Since all screens, strainers, filters etc. must be removed prior to beginning the CIP cycles. The very nature of these devices restrict and impede high flow rates necessary for automatic machine cleaning and consequently, must be cleaned manually. The machine operator will be prompted to perform this function before going forward with CIP.

While the invention has been particularly shown and described with respect to the preferred embodiments thereof, it will be understood by those skilled in the art that the foregoing and other changes in form and details may be made therein without departing from the spirit and scope of the invention, which should be limited only by the scope of the appended claims.

We claim:

1. A high-speed system for washing bottles comprising:

(a) carrier means for sequentially receiving and carrying a plurality of bottles in an inverted position through portions of said system, each bottle of said plurality of bottles being individually rotated about its own axis while in said inverted position;

(b) a plurality of means for inserting one of a plurality of spray nozzles into each individual inverted bottle as it rotates about its own axis, each of said spray nozzles directing jets of at least a first fluid and second fluid against an internal bottom portion and inner wall portion of said bottle for cleansing thereof;

(c) control means for enabling sequential discharge of at least said first fluid and said second fluid from each of said nozzles for respective first and second predetermined periods of time and at predetermined pressures, wherein said first fluid is a high temperature caustic wash solution which simultaneously chemically and physically removes soils from each of said bottles; and (d) means for purging said bottle of said high temperature caustic wash solution with said second fluid.

2. The system according to claim 1 wherein said control means is a programmable logic controller.

3. The system according to claim 2 further including means for comparing said flow rate of said first fluid with a predetermined flow rate to determine if one or more of said plurality of spray nozzles are clogged.

4. The system according to claim 3 further including means for tracking each discrete spray nozzle throughout its travel on said carrier.

5. The system according to claim 4 wherein said control means further includes means for generating a flag associated with a discrete spray nozzle when said flow rate varies from said predetermined flow rate, said means including memory means for assigning said flag to a discrete nozzle position when said flow rate varies.

6. The system according to claim 5 wherein said control means further includes means for rejecting a bottle treated by said flagged discrete spray nozzle.

7. The system according to claim 6 wherein said predetermined flow rate ranges from 0.5 $Kg/cm^2$ to 1.5 $Kg/cm^2$.

8. The system according to claim 1 further including a flow sensor for sensing a flow rate of said first fluid supplied to said plurality of spray nozzles.

9. The system according to claim 1 wherein said high temperature caustic wash solution is a 3% NaOH solution having a pH ranging from 12.0 to 13.0.

10. The system according to claim 9 wherein said 3% NaOH solution further includes wetting and suspension compounds.

11. The system according to claim 1 further including means for self-cleaning said high speed system, said self cleaning means including means for supplying an acidic solution to said spray nozzles.

12. The system according to claim 1 wherein said second fluid is air.

13. The system according to claim 1 wherein said first predetermined period of time ranges from 10 to 30 seconds.

14. The system according to claim 1 wherein said second predetermined period of time ranges from 1 to 5 seconds.

15. A high-speed system for washing bottles comprising:

(a) a plurality of carrier means for sequentially receiving and carrying bottles in an inverted position through portions of said system, each said bottle being individually rotated about its own axis while in said inverted position;

(b) a plurality of means for inserting one of a plurality of a spray nozzles into each individual inverted bottle as it rotates about its own axis, each of said spray nozzles directing jets of at least a first fluid, second fluid and third fluid against an internal bottom portion and inner wall portion of said bottle for cleansing thereof;

(c) control means for enabling sequential discharge of at least said first fluid, said second fluid and said third fluid from each of said nozzles for respective first, second and third predetermined periods of time and at predetermined pressures, wherein said first fluid is a high temperature caustic wash solution for chemically dissolving and physically removing soils from said internal bottom portion;

(d) means for purging said bottle of said high temperature caustic wash solution with said second fluid; and (e) means for neutralizing said bottle with said third fluid after purging said bottle of said high temperature caustic wash solution.

16. The system according to claim 15 further including a flow sensor for sensing a flow rate of said third fluid supplied to said spray nozzles.

17. The system according to claim 16 further including means for comparing said flow rate of said third fluid with a predetermined flow rate to determine a clogged spray nozzle condition.

18. The system according to claim 17 further including means for tracking each discrete spray nozzle throughout its travel on said carrier.

19. The system according to claim 18 wherein said control means further includes means for generating a flag associated with a discrete spray nozzle when said flow rate varies from said predetermined flow rate, said means including memory means for assigning said flag to a discrete nozzle position when said flow rate varies.

20. The system according to claim 19 wherein said control means further includes means for rejecting a bottle treated by said flagged discrete spray nozzle.

21. The system according to claim 20 wherein said predetermined flow rate ranges from 0.5 $Kg/cm^2$ to 1.5 $Kg/cm^2$.

22. The system according to claim 15 wherein said third fluid is an acidic solution having a pH ranging from 2.0 to 4.0.

23. The system according to claim 22 further including means for maintaining the pressure of said acidic solution between 0.0 $Kg/cm^2$ and 4.5 $Kg/cm^2$.

24. An automatic high-speed system for washing bottles comprising:

(a) an endless loop bottle carrier with a plurality of moving bottle receiving stations mounted thereon for receiving bottles in an inverted position and rotating each bottle about its own axis while in said inverted position, said carrier having a discharge position for discharging bottles held thereby;

(b) a plurality of means for inserting a spray nozzle into each individual inverted bottle as it rotates about its own axis, each of said spray nozzles directing jets of at least a first fluid and second fluid against an internal bottom portion and inner wall portion of said bottle for cleansing thereof;

(c) control means for enabling sequential discharge of at least said first fluid and said second fluid from each of said nozzles for respective first and second predetermined periods of time and at predetermined pressures, wherein said first fluid is a high temperature caustic wash solution which simultaneously chemically and physically removes soils from said internal bottom portion; and (d) means for purging said bottle of said high temperature caustic wash solution with said second fluid.

25. The system according to claim 24 wherein said endless loop carrier comprises at least one rotating carousel containing said bottle stations.

26. The system according to claim 25 wherein said control means regulates the rotational speed of said rotating carousel.

27. The system according to claim 26 further including strobe means for sequentially assigning a position to each of said moving bottle receiving stations, each position having associated therewith a plurality of attribute registers corresponding to the operational state of said bottle receiving station.

28. The system according to claim 27 further including means for identifying said position of each bottle receiving station throughout its travel on said carrier.

29. The system according to claim 28 further including means for assigning data to one or more of said plurality of attribute registers associated with an identified bottle receiving station, said data representing the current operational state of said bottle receiving station.

30. The system according to claim 29 further including means for comparing data contained in the attribute registers associated with a bottle receiving station located at said discharge position with predetermined attribute data indicating a defective bottle receiving station, said comparing means including means for flagging said bottle when the data present in one attribute register equals said predetermined attribute data.

31. An automatic high-speed system for washing bottles comprising:

(a) an endless loop bottle carrier with a plurality of moving bottle receiving stations mounted thereon, each of said bottle receiving stations having a first means for holding an individual bottle in an inverted position;

(b) mechanical drive means for rotating each said bottle about its own axis while being held by said first means;

(c) means for inserting a spray nozzle into each individual inverted bottle as it rotates about its own axis, each of said spray nozzles directing jets of at least a first fluid and second fluid against an internal bottom portion and inner wall portion of said bottle for cleansing thereof;

(d) programmable logic control means for controlling the speed of said mechanical drive means and for enabling sequential discharge of at least said first and second fluid from each of said nozzles for a respective first and second predetermined period of time, wherein said first fluid is a high temperature caustic wash solution which simultaneously physically and chemically removes soils from said bottle; and (e) means for purging said bottle of said high temperature caustic wash solution with said second fluid.

32. The system according to claim 31 wherein said programmable logic controller includes means for inputting predetermined setpoint values corresponding to a desired temperature and pH concentration of said first fluid.

33. The system according to claim 32 wherein said programmable logic controller includes means for inputting predetermined setpoint values corresponding to a desired rotational speed of said first means for holding and rotating said bottles.

34. The system according to claim 33 wherein said programmable logic control means includes means for comparing a current measured pH concentration value of said first fluid with a predetermined pH concentration value, said comparing means including means for adjusting the pH concentration of said first fluid when said current pH concentration value varies from said predetermined pH concentration temperature value and for generating an alarm signal for indication thereof.

35. The system according to claim 34 further including strobe means for sequentially assigning a position number to each of said moving bottle receiving stations, each position number having associated therewith a plurality of attribute registers corresponding to the operational state of said bottle receiving station.

36. The system according to claim 35 further including means for identifying said position number of each bottle receiving station throughout its traversal about said carrier.

37. The system according to claim 36 further including means for assigning data to one or more of said plurality of attribute registers associated with an identified bottle receiving station, said data representing the current operational state of said bottle receiving station.

38. The system according to claim 37 further including means for comparing data contained in the attribute registers associated with a bottle receiving station located at said discharge position with predetermined attribute data indicating a defective bottle receiving station, said comparing means including means for flagging said bottle when the data present in one attribute register equals said predetermined attribute data.

* * * * *